US006634259B2

(12) United States Patent
Castille

(10) Patent No.: US 6,634,259 B2
(45) Date of Patent: Oct. 21, 2003

(54) APPARATUS AND METHOD FOR CONNECTING WELLBORE TUBULARS

(75) Inventor: Dale J. Castille, Lafayette, LA (US)

(73) Assignee: Frank's International, Inc., Houston, TX (US)

( * ) Notice: Subject to any disclaimer, the term of this patent is extended or adjusted under 35 U.S.C. 154(b) by 0 days.

(21) Appl. No.: 10/021,225

(22) Filed: Dec. 12, 2001

(65) Prior Publication Data

US 2002/0078798 A1 Jun. 27, 2002

Related U.S. Application Data

(63) Continuation of application No. 09/553,597, filed on Apr. 20, 2000, now abandoned.

(51) Int. Cl.[7] ..... B25B 13/50
(52) U.S. Cl. ..... 81/57.34; 81/57.16
(58) Field of Search ..... 81/57.16, 57.21, 81/57.33, 57.34, 57.36

(56) References Cited

U.S. PATENT DOCUMENTS 4,696,206 A * 9/1987 Renfro ..... 81/57.34
5,060,542 A * 10/1991 Hauk ..... 81/57.34
5,386,746 A * 2/1995 Hauk ..... 81/57.34
5,868,045 A * 2/1999 Hauk ..... 81/57.34

* cited by examiner

*Primary Examiner*—James G. Smith
(74) *Attorney, Agent, or Firm*—The Matthews Firm

(57) ABSTRACT

The present invention discloses an apparatus and method for controlling a power tong unit having a power spinner and, in a preferred embodiment, three power jaws. The control system controls grip pressure applied by a selected power jaw to a first wellbore tubular to provide a relatively reduced grip pressure when the power spinner is activated to thereby rotate a second wellbore tubular at a relatively high rotation speed but with a relatively low torque. The control system applies a relatively high grip pressure to two selected power jaws used for applying high torque but at a relatively slow rotation speed for final making up or initial breaking out of the wellbore tubulars with respect to each other.

15 Claims, 3 Drawing Sheets

APPARATUS AND METHOD FOR CONNECTING WELLBORE TUBULARS

RELATED APPLICATION

This Application is a continuation of U.S. patent application Ser. No. 09/553,597, filed Apr. 20, 2000 now abandoned.

BACKGROUND OF THE INVENTION

1. Field of the Invention

The present invention relates to a power tong for connecting and disconnecting wellbore tubulars and, more specifically, to apparatus and method for controlling a grip of each of a plurality of power jaws.

2. Background of the Invention

The speed of connecting and disconnecting hundreds of wellbore tubulars makes a great difference in the time required to drill and bring a well into production. For instance, it is normally necessary to insert and remove the drill several times during the drilling process wherein numerous connections of the wellbore tubulars have to be made or broken. Due to the high cost of drilling equipment, it is therefore desirable to be able to make or break a connection as quickly as possible to keep drilling costs as low as possible.

One apparatus known for making and breaking wellbore tubulars includes a frame that supports up to three power jaws and a power spinner each aligned vertically with respect to each other. An exemplary example of such an apparatus is disclosed in U.S. Pat. No. 5,386,746 and is incorporated herein by reference. Preferably such an apparatus should be able to spin one tubular with the power spinner at a relatively high speed but at a relatively low torque while holding another tubular fixed with one of the power jaws. The spin process continues until the two threaded tubulars shoulder up, e.g. until a pin shoulder engages the box shoulder. After shouldering up, the power spinner is stopped and two of the power jaws are used to apply high torque to the connection or joint in a well known manner so the joint is securely fastened and sealed. The application of high torque continues to rotate the tubulars with respect to each other but at a very low speed of rotation. However, once the tubulars are shouldered it is not necessary to rotate but a relatively small amount so the low speed of rotation does not slow the process down. Likewise when breaking out joints, two power jaws apply a high torque to initially break the connection. Then the power spinner spins one tubular with respect to another tubular held by a power jaw until the threaded connection is completely disconnected. In this manner, the connectors can be quickly made or broken to save considerable time and money while drilling a well.

It was found that with certain types of wellbore tubulars such as new types of wellbore tubulars, the two tubulars were not always shouldered up during the spinning process. Because the tubulars were not shouldered up during the spinning process, substantial additional rotation was required with the power jaws until the tubulars were properly tightened. Providing substantial additional rotation with power jaws tends to be a slow process. Locating the problem of not shouldering up is a difficult process which could result from many causes. For instance, due the vertically stacked nature of the power jaws and power spinner in conjunction with the drilling rig slips and elevator for holding the two tubulars there are many alignment factors that are difficult to isolate. Therefore, those skilled in the art will appreciate the present invention that addresses these and other problems.

SUMMARY OF THE INVENTION

The present invention provides for a power tong for making up and breaking out wellbore tubulars. The invention comprises a power spinner for spinning the wellbore tubulars and a plurality of power jaws. At least one of the plurality of power jaws is preferably operable for gripping a respective first of the wellbore tubulars with a first grip pressure. The power jaw holds the respective first of the wellbore tubulars when the power spinner is spinning a respective second of the wellbore tubulars. Each of the plurality of power jaws is preferably operable for gripping the wellbore tubulars with a second grip pressure for applying high torque to the wellbore tubulars. The second grip pressure is preferably greater than the first grip pressure. A grip control is preferably provided for controlling at least one of the plurality of power jaws for automatically producing the first grip pressure during the spinning by the power spinner.

In a presently preferred embodiment, the plurality of power jaws includes three vertically oriented power jaws and the power spinner is preferably vertically oriented with respect to the three vertically oriented power jaws. A control unit may be provided to produce a control signal to activate the power spinner. The grip control is preferably responsive to the control signal to automatically shift to the first grip pressure.

A pressure limiting valve for each power jaw may preferably be used for producing the first grip pressure. A grip cylinder is preferably used with each of the plurality of power jaws and the pressure limiting valve controls pressure to the grip cylinder to produce the first grip pressure. In a preferred embodiment, one pressure limiting valve is preferably responsive to air pressure for controlling a hydraulic pressure. A grip cylinder valve may be used for controlling pressure to the grip cylinder to produce the second grip pressure. A frame for supporting the power spinner and the plurality of power jaws is preferably provided.

In operation, a power spinner is provided for spinning a first wellbore tubular. At least one power jaw is utilized for gripping and holding in position a second wellbore tubular as the first wellbore tubular is spinning with respect to second wellbore tubular for making up or breaking out a threaded connection. The at least one power jaw holds the second wellbore tubular with a first grip pressure. At least two power jaws are utilized for applying high torque for a final making up or an initial breaking out of the threaded connection. The at least two power jaws grip respective of the first and second tubulars with a second grip pressure for applying high torque. A grip control circuit is provided such that the first grip pressure is reduced as compared to the second grip pressure whenever the power spinner is spinning the first wellbore tubular.

In a preferred embodiment, a power spinner control circuit is provided that produces a spin control signal. The spin control signal is utilized to produce the first grip pressure. A grip cylinder provided for the power jaw, and pressure to the grip cylinder is controlled in response to the spin control signal.

In more detail, a power tong for making up and breaking out wellbore tubulars is provided with a first power jaw having a first gripping cylinder, a second power jaw having a second gripping cylinder, and a third power jaw having a third gripping cylinder. The first gripping cylinder controls a grip of the first power jaw, the second gripping cylinder controls a grip of the second power jaw, and the third gripping cylinder controls a grip of the third power jaw. A power spinner is used for spinning one of the wellbore tubulars while at least one of the power jaws grips another of the wellbore tubulars. A spinner control circuit activates the power spinner. A gripping control circuit for controls one of the gripping cylinders. The gripping control circuit is preferably operable for applying a first pressure to at least two of the gripping cylinders during a high torque operation for the making up or breaking out. The gripping control circuit is preferably responsive to the spinner control circuit for producing a second pressure smaller than the first pressure when the power spinner is activated and for applying the second pressure to at least one of the first gripping cylinder and the second gripping cylinder and the third gripping cylinder.

Following a review of the above drawings in conjunction with the following claims and description, various objects, features, and advantages of the present invention will become apparent to those of skill in the art.

DESCRIPTION OF THE PREFERRED EMBODIMENT(S)

Figure 1:
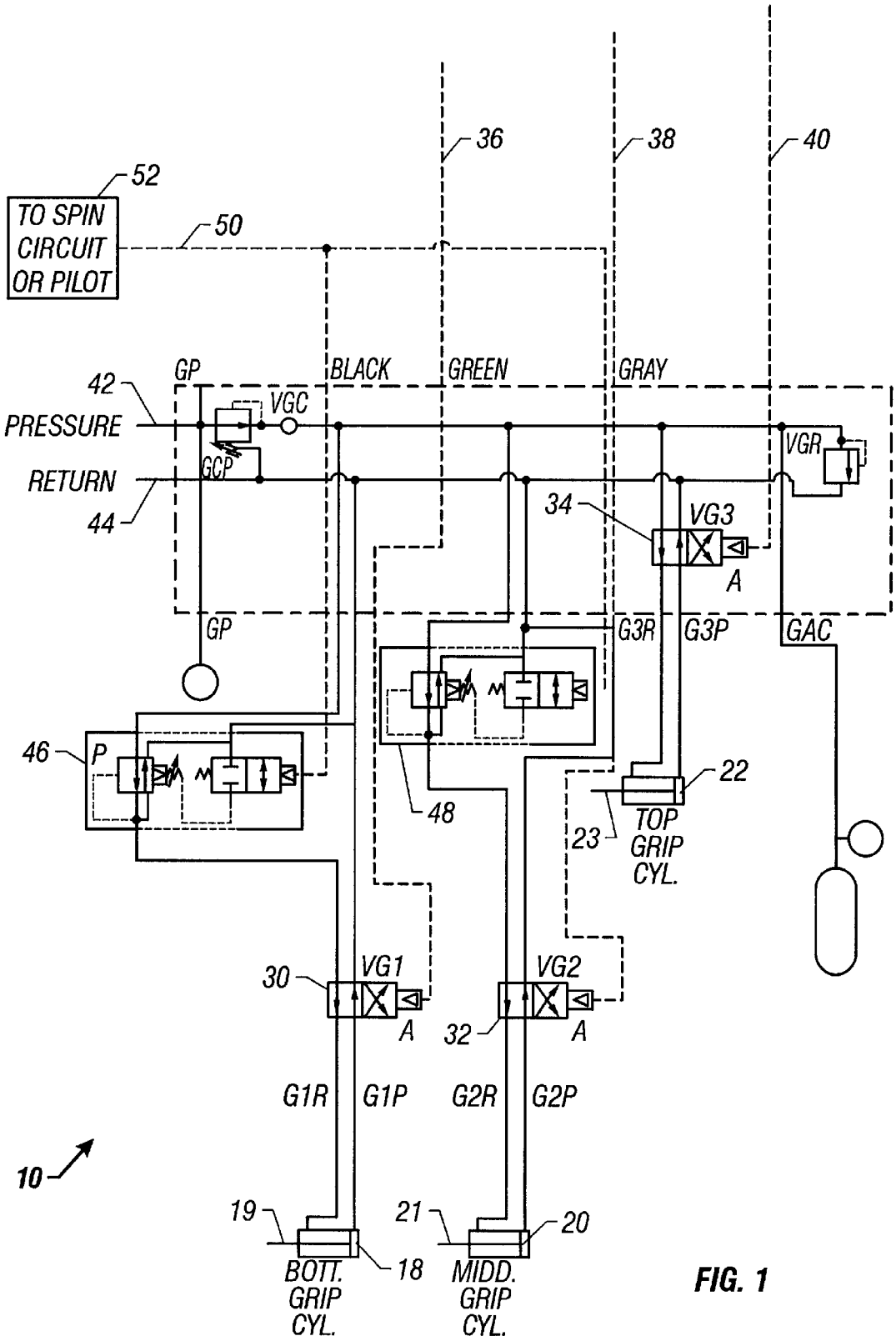
FIG. 1 is a schematic showing a power jaw grip control circuit in accord with the present invention.
Figure 2:
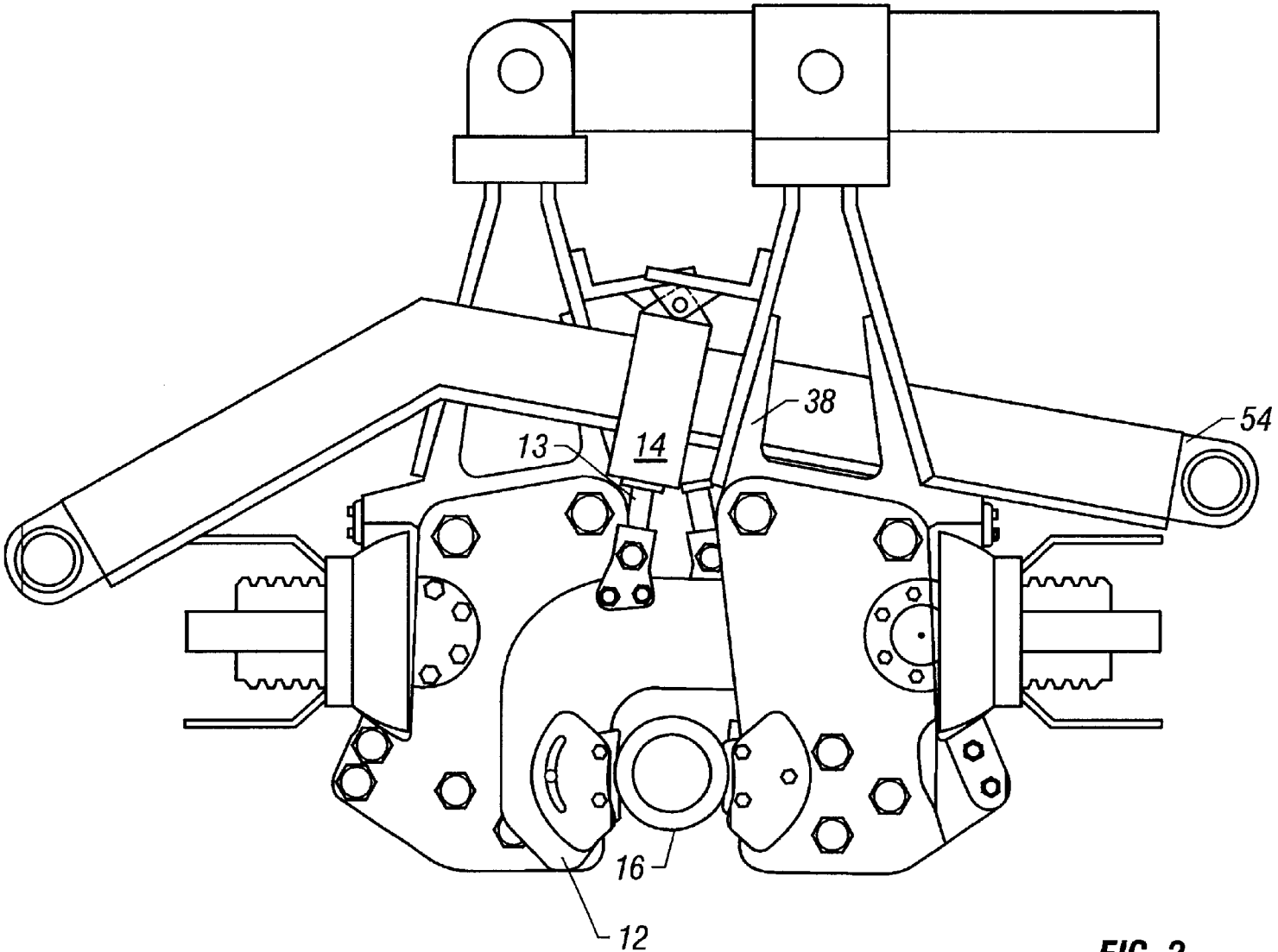
FIG. 2 is an elevational view, partially in section, showing a power jaw in accord with the present invention.

Referring now to the drawings, and more specifically to FIGS. 1 and 2, there is shown in FIG. 1 a grip control circuit 10 for controlling a power jaw such as power jaw 12 of FIG. 2. Grip cylinder 14 is used to apply a grip pressure to tubular 16 through power jaw 12. In a preferred embodiment, three power jaws are used that are substantially identical to power jaw 12.

Figure 3:
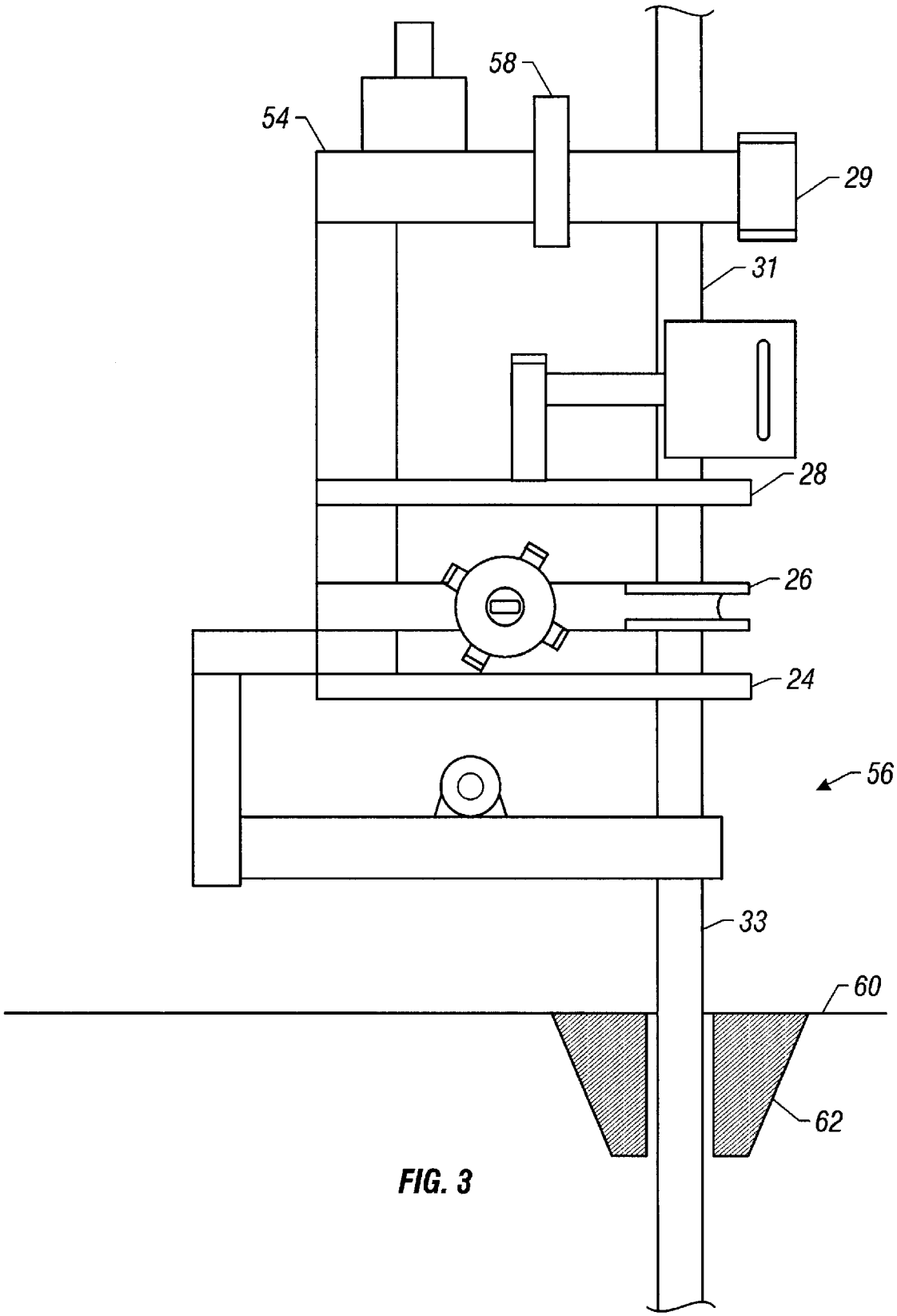
FIG. 3 is an elevational view, of a power tong apparatus in accord with the present invention.

In the preferred embodiment, each power jaw 12 applies a grip pressure to wellbore tubular 16 as determined by a grip cylinder, such as grip cylinder 14 shown in FIG. 2, and such as bottom grip cylinder 18, middle grip cylinder 20, and top grip cylinder 22 shown in FIG. 1. In FIG. 2, grip cylinder 14 is used to apply grip pressure to power jaw 12 through cylinder rod 13. Referring to the schematic of FIG. 1, grip cylinders 18, 20, and 22 may preferably be used to operate power jaws such as bottom power jaw 24, middle power jaw 26, and top power jaw 28, respectively, as shown in FIG. 3.

Power spinner 29 is used for relatively low torque but relatively high speed spinning of wellbore tubulars such as tubular 31 with respect to wellbore tubular 33. Power spinner 29 quickly screws the connectors together prior to applying high torque to finally make the connection and quickly unscrews the connectors after applying high torque to initially break the connection. Referring to FIG. 3, it will be seen that in a preferred embodiment, frame 54 is used to support power jaws 24, 26, and 28 in a vertical orientation. Likewise, power spinner 29 is vertically oriented with respect to the vertically oriented power jaws. Power tong unit 56 may typically be supported by cable 58 above rig floor 60. Slips 62 may be used to hold wellbore tubular 33 and the rest of the tubular string that extends into the wellbore. Elevators (not shown) are used to lift and support wellbore tubular 31 into alignment with wellbore tubular 33 for threaded engagement.

In grip control circuit 10 of FIG. 1, hydraulic fluid supply lines are generally indicated as solid lines and control lines are generally indicated in dash. Control lines could be air lines or hydraulic lines. Air logic is often conveniently used in wellbore areas where electric control lines could cause a spark. Valve 30 supplies hydraulic pressure to bottom grip cylinder 18 to move cylinder rod 19 in and out. Valve 32 supplies hydraulic pressure to middle grip cylinder 20 to move cylinder rod 21 in and out. Valve 34 supplies hydraulic pressure to top grip cylinder 22 to move cylinder rod 23 in and out. Control line 36 activates valve 30, control line 38 activates valve 32, and control line 40 activates valve 34. The control lines are activated as the respective power jaws are used. Two power jaws are used together for applying high torque to make or break connections. Since middle power jaw 26 is opposing top power jaw 28 and bottom power jaw 24, middle power jaw 26 is used to apply high torque for both making and breaking connections.

In the present invention, power spinner 29 is used with either lower power jaw 24 or middle power jaw 26 depending on whether the wellbore tubulars are being made up or broken out. The respective power jaws are used as a backup to grip and hold wellbore tubular 33 while power spinner 29 rotates wellbore tubular 31. Hydraulic pressure is available through hydraulic pressure line 42 and hydraulic return line 44. In accord with the present invention, pressure reducing/relieving valve 46 may be activated to control or limit hydraulic pressure available at valve 30 and bottom grip cylinder 18 to control the grip pressure of bottom power jaw 24. Likewise, pressure reducing/relieving valve 48 may be activated to control or limit hydraulic pressure available at valve 32 and middle grip cylinder 20 to control the grip pressure of middle power jaw 26. Pressure reducing/relieving valves 46 and 48 are activated by control line 50 from control unit 52. In a preferred embodiment, control unit 52 provides air logic for operating features of the power tong including power spinner 29. Control unit 52 may also preferably control many other elements of the power tong unit. When control unit 52 produces a spin control signal on control line 50, then spinner 29 operates. Control line 50 is also connected to activate reducing/relieving valves 46 and 48. Thus, grip control 10 is responsive to a spin control signal to decrease grip pressure at lower power jaw 24 and middle power jaw 26 when spinner 29 is spinning wellbore tubular 31. When applying high torque, spinner 29 is not activated so the grip pressure at lower power jaw 24 and middle power jaw 26 will be higher. After extensive testing, it was finally discovered that the high grip pressure used for applying high torque may occasionally slightly distort certain wellbore tubulars, which may be of new design, during the spinning process when the pin and box threaded connectors are not mutually supported. Therefore, the wellbore tubulars did not shoulder up when spinning with power spinner 29. This necessitates extra rotation with power jaws that tends to be quite slow. By reducing pressure with valves 46 and 48 during the spinning mode only, testing showed that the problem was eliminated. In a preferred embodiment of the invention, grip pressure on lower power jaw 24 and middle power jaw 26 was set at approximately 2000 psi on respective bottom grip cylinder 18 and middle grip cylinder 20. It should be understood that the particular setting is nominal and that the appropriate setting will provide a grip pressure for the power jaw that is adequate to reliably grip the wellbore tubular without being so powerful as to distort the connector of the tubular. Thus, the present invention provides pressure reducing/relieving valves to produce an automatic high/low grip pressure responsive to a spin signal that is preferably activated whenever the spinner is activated.

In summary, for high torque operation used to apply high torque to wellbore tubulars 31 and 33, two selected valves 30, 32, and 34 are used to apply a relatively high grip pressure to two selected power jaws 24, 26, and 28 respectively depending on whether the wellbore tubulars are being made up or broken out. The high torque operation has been known in the prior art. When power spinner 29 is activated for relatively high speed rotation of wellbore tubular 31 with respect to wellbore tubular 33, then gripping pressure of the selected power jaw 24 or 26 used to grip and hold wellbore tubular 33 from spinning is preferably automatically reduced. This automatic reduction is produced using spin control line 50 to activate pressure reducing/relieving valves 46 and 48 to thereby reduce grip pressure applied to the selected bottom grip cylinder 18 or middle grip cylinder 20. As noted above, the appropriate power jaw is selected based on whether the wellbore tubulars are being made up or broken out. Thus, whenever power spinner 29 is activated to spin wellbore tubular 31, then the appropriate power jaw grips wellbore tubular 33 with a reduced pressure grip.

Those skilled in the art will appreciate that many modifications could be made to the present invention without changing the spirit of the invention. For instance, the particular hydraulics and air controls of the present invention could be changed so that a different control circuit is provided that performs the same function of reducing the grip pressure of the power jaw. Different arrangements of power jaws could be used with the present invention such as having two power jaws instead of three. As well, while an automatic control responsive to power spinner activation is preferred, the grip control could be manual or separately activated. Therefore, it will be understood that the present invention is descriptive only of a presently preferred embodiment and that many variations size, shape, orientation, materials, arrangement, types of controls, and the details of the illustrated construction could be made without departing from the spirit of the invention.

I claim:

1. A power tong for making up and breaking out wellbore tubulars, comprising:

a power spinner for spinning said wellbore tubulars;

a plurality of power jaws;

a torquing cylinder connected to said plurality of power jaws for applying a high torque to said wellbore tubulars by slowly rotating at least two of said plurality of power jaws with respect to each other;

at least one of said plurality of power jaws being operable for gripping a respective first of said wellbore tubulars with a first grip pressure for holding said respective first of said wellbore tubulars when said power spinner is spinning a respective second of said wellbore tubulars;

each of said plurality of power jaws being operable for gripping said wellbore tubulars with a second grip pressure for applying said high torque to said wellbore tubulars with said torquing cylinder, said second grip pressure being greater than said first grip pressure; and a grip control for controlling said at least one of said plurality of power jaws for automatically producing said first grip pressure during said spinning by said power spinner and said second grip pressure when applying said high torque with said torquing cylinder.

2. The power tong of claim 1, further comprising:

said plurality of power jaws including three vertically oriented power jaws; and said power spinner being vertically oriented with respect to said three vertically oriented power jaws.

3. The power tong of claim 1, further comprising:

a control unit to produce a control signal to activate said power spinner, said grip control being responsive to said control signal to automatically shift to said first grip pressure.

4. The power tong of claim 1, wherein said grip control further comprises:

at least one pressure limiting valve for producing said first grip pressure.

5. The power tong of claim 4, further comprising:

at least one grip cylinder secured to said at least one of said plurality of power jaws, said at least one pressure limiting valve controlling pressure to said at least one grip cylinder to produce said first grip pressure.

6. The power tong of claim 4, wherein:

said at least one pressure limiting valve being responsive to air pressure for controlling a hydraulic pressure.

7. The power tong of claim 5, further comprising:

at least one grip cylinder valve for controlling pressure to said at least one grip cylinder to produce said second grip pressure.

8. The power tong of claim 7, further comprising:

a frame for supporting said power spinner and said plurality of power jaws.

9. A power tong for making up and breaking out wellbore tubulars, comprising:

a first power jaw having a first gripping cylinder;

a second power jaw having a second gripping cylinder;

a third power jaw having a third gripping cylinder, said first gripping cylinder controlling a grip of said first power jaw, said second gripping cylinder controlling a grip of said second power jaw, said third gripping cylinder controlling a grip of said third power jaw;

a torquing cylinder for applying a high torque to said wellbore tubulars by slowly rotating at least two of said first power jaw, said second power jaw, and said third power jaw with respect to each other;

a power spinner for spinning one of said wellbore tubulars while at least one of said first power jaw or said second power jaw or said third power jaw grips another of said wellbore tubulars;

a spinner control circuit for activating said power spinner;

a gripping control circuit for controlling said first gripping cylinder and said second gripping cylinder and said third gripping cylinder, said gripping control circuit being operable for applying a first pressure to at least two of said first gripping cylinder and said second gripping cylinder and said third gripping cylinder during said applying of high torque with said torquing cylinder for making up or breaking out, said gripping control circuit being responsive to said spinner control circuit for producing a second pressure smaller than said first pressure when said power spinner is activated and for applying said second pressure to at least one of said first gripping cylinder and said second gripping cylinder and said third gripping cylinder.

10. The power tong of claim 9, further comprising:

one or more main valves for said gripping control circuit for said applying of said first pressure to at least two of said first gripping cylinder and said second gripping cylinder and said third gripping cylinder during said high torque operation for said making up or breaking out.

11. The power tong of claim 9, further comprising:

a first main valve for said first gripping cylinder, a second main valve for said second gripping cylinder, and a third main valve for said third gripping cylinder.

12. The power tong of claim 9, wherein said gripping control circuit includes a pressure limiting control responsive to said spinner control circuit.

13. The power tong of claim 12, further comprising:

one or more secondary valves for said pressure limiting control for said applying of said second pressure instead of said first pressure to at least one of said first gripping cylinder and said second gripping cylinder and said third gripping cylinder when said power spinner is activated.

14. The power tong of claim 13, wherein said one or more secondary valves of said pressure limiting control are operable to apply said second pressure to at least two of said first gripping cylinder and said second gripping cylinder and said third gripping cylinder.

15. The power tong of claim 13, further comprising:

a first secondary valve for said first gripping cylinder, and a second secondary valve for said second gripping cylinder.

* * * * *